US010591124B2

(12) United States Patent
Kushalappa et al.

(10) Patent No.: US 10,591,124 B2
(45) Date of Patent: Mar. 17, 2020

(54) HEAT DISSIPATING SYSTEM FOR A LIGHT, HEADLAMP ASSEMBLY COMPRISING THE SAME, AND METHOD OF DISSIPATING HEAT

(75) Inventors: Poovanna Theethira Kushalappa, Bangalore (IN); Triloka Chander Tankala, Chennai (IN); Arunachala Parameshwara, Bangalore (IN)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 259 days.

(21) Appl. No.: 13/599,409

(22) Filed: Aug. 30, 2012

(65) Prior Publication Data

US 2014/0063829 A1 Mar. 6, 2014

(51) Int. Cl.

| | |
|---|---|
| ***F21V 29/00*** | (2015.01) |
| ***F21S 41/141*** | (2018.01) |
| ***F21S 41/143*** | (2018.01) |
| ***F21S 45/47*** | (2018.01) |
| ***F21S 45/49*** | (2018.01) |
| ***F21S 45/48*** | (2018.01) |

(52) U.S. Cl.

CPC ..... *F21S 41/141* (2018.01); *F21S 41/143* (2018.01); *F21S 45/47* (2018.01); *F21S 45/48* (2018.01); *F21S 45/49* (2018.01)

(58) Field of Classification Search

CPC .. B62J 6/00; B62J 6/02; B60Q 1/0041; B60Q 1/0683; F21Y 2101/02; F21S 48/145; F21S 48/335; F21S 41/141; F21S 41/143; F21S 45/49; F21S 45/47; F21S 45/48; F21V 29/004; Y10T 29/49002

USPC ..... 362/294, 475, 507, 547

See application file for complete search history.

(56) References Cited

U.S. PATENT DOCUMENTS 5,615,573 A * 4/1997 Lee ..... 73/295
6,888,723 B2 5/2005 Kamiya et al.
(Continued)

FOREIGN PATENT DOCUMENTS

CA 2586342 A1 4/2007
CN 201081206 Y 7/2008
(Continued)

OTHER PUBLICATIONS

Chinese Patent No. 101315177 (A); Publication Date: Dec. 3, 2008; Abstract Only; 1 Page.
(Continued)

*Primary Examiner* — Y M. Lee
*Assistant Examiner* — Y M Quach Lee
(74) *Attorney, Agent, or Firm* — Cantor Colburn LLP

(57) ABSTRACT

In an embodiment, a heat dissipating system for a light can include: a light source comprising an LED; a reflector adjacent the LED; a housing around the LED module; and a flexible conductive connector attached at one end to a heat sink and at another end to the light source, and configured to conduct heat away from the light source and to the heat sink. The heat sink is located remote from the light source. In an embodiment, a method of dissipating heat away from a LED module can include: conducting heat from the LED module through a flexible conductive connector to a heat sink, wherein a lamp comprises the LED module, a housing, and a reflector, and wherein the heat sink is located external to the LED housing.

20 Claims, 8 Drawing Sheets

(56) References Cited

U.S. PATENT DOCUMENTS

| | | | | |
|---|---|---|---|---|
| 6,953,274 | B2 | 10/2005 | Rice | |
| 7,019,334 | B2 | 3/2006 | Yatsuda et al. | |
| 7,547,922 | B2 | 6/2009 | Tan et al. | |
| 7,682,052 | B2 | 3/2010 | Coushaine | |
| 7,690,826 | B2 | 4/2010 | Kim | |
| 7,731,402 | B2 | 6/2010 | Tessnow et al. | |
| 7,780,315 | B2 | 8/2010 | Gasquet et al. | |
| 7,985,981 | B2 | 7/2011 | Hashimoto et al. | |
| 7,993,045 | B2 * | 8/2011 | Nakamura et al. | 362/545 |
| 8,070,339 | B2 * | 12/2011 | Koike | 362/538 |
| 8,071,998 | B2 | 12/2011 | Chen | |
| 8,076,692 | B2 | 12/2011 | Kim et al. | |
| 8,080,942 | B2 | 12/2011 | Heider et al. | |
| 8,100,569 | B2 * | 1/2012 | Owada | 362/520 |
| 8,105,853 | B2 | 1/2012 | Xu | |
| 8,523,416 | B2 * | 9/2013 | Ohmi et al. | 362/538 |
| 8,746,927 | B1 * | 6/2014 | Nepple | F21L 4/005 362/147 |
| 2006/0228542 | A1 * | 10/2006 | Czubarow | 428/323 |
| 2007/0035224 | A1 * | 2/2007 | Yee | G03B 21/16 313/46 |
| 2007/0070229 | A1 * | 3/2007 | Shizuno | H01L 23/3114 348/294 |
| 2007/0109801 | A1 | 5/2007 | Panopoulos | |
| 2007/0230182 | A1 | 10/2007 | Tai et al. | |
| 2007/0268703 | A1 | 11/2007 | Gasquet et al. | |
| 2008/0025038 | A1 | 1/2008 | Chiang | |
| 2008/0062698 | A1 | 3/2008 | Tai et al. | |
| 2008/0067535 | A1 | 3/2008 | Wu et al. | |
| 2008/0079368 | A1 * | 4/2008 | Kennedy | F21L 4/00 315/158 |
| 2008/0137308 | A1 | 6/2008 | MacDonald et al. | |
| 2008/0232129 | A1 | 9/2008 | Lyons | |
| 2008/0247177 | A1 | 10/2008 | Tanaka et al. | |
| 2008/0266869 | A1 | 10/2008 | Tai et al. | |
| 2009/0154180 | A1 | 6/2009 | Cho et al. | |
| 2009/0278461 | A1 | 11/2009 | Lee et al. | |
| 2010/0013366 | A1 | 1/2010 | Hare | |
| 2010/0271836 | A1 | 10/2010 | Bakk | |
| 2011/0103076 | A1 | 5/2011 | Beck et al. | |
| 2011/0103080 | A1 | 5/2011 | Kalhoff | |
| 2011/0110108 | A1 * | 5/2011 | Calon | F21V 29/02 362/373 |
| 2011/0174071 | A1 | 7/2011 | Ludwig | |
| 2011/0227507 | A1 * | 9/2011 | Salm | F21S 10/02 362/294 |
| 2011/0279035 | A1 | 11/2011 | Van Dijk et al. | |
| 2011/0284864 | A1 | 11/2011 | Jeong | |
| 2011/0308770 | A1 | 12/2011 | Cho | |
| 2012/0007076 | A1 | 1/2012 | Cho | |
| 2012/0294024 | A1 * | 11/2012 | Peck et al. | 362/516 |
| 2014/0003039 | A1 * | 1/2014 | Steadman | F21S 8/02 362/147 |

FOREIGN PATENT DOCUMENTS

| | | | |
|---|---|---|---|
| CN | 201110485 | Y | 9/2008 |
| CN | 201133600 | Y | 10/2008 |
| CN | 201141573 | Y | 10/2008 |
| CN | 101315177 | A | 12/2008 |
| CN | 201173467 | Y | 12/2008 |
| CN | 201437917 | U | 4/2010 |
| CN | 201462624 | U | 5/2010 |
| CN | 201819170 | U | 5/2011 |
| CN | 102278728 | A | 12/2011 |
| DE | 3903868 | C1 | 4/1990 |
| DE | 102008030353 | A1 | 12/2009 |
| DE | 202010005528 | U1 | 10/2010 |
| DE | 102008031432 | B4 | 7/2011 |
| DE | 102010026344 | A1 | 1/2012 |
| EP | 0770817 | A1 | 5/1997 |
| EP | 2194311 | A2 | 6/2010 |
| EP | 1962568 | B1 | 8/2011 |
| FR | 2926926 | A1 | 1/2008 |
| FR | 2926947 | A1 | 5/2008 |
| JP | 2008135260 | A | 6/2008 |
| JP | 2008204844 | A | 9/2008 |
| JP | 2008218386 | A | 9/2008 |
| JP | 2008218761 | A | 9/2008 |
| JP | 2008235867 | A | 10/2008 |
| JP | 2008293692 | A | 12/2008 |
| JP | 2009087620 | A | 4/2009 |
| JP | 2009146706 | A | 7/2009 |
| JP | 2009187707 | A | 8/2009 |
| JP | 2009283406 | A | 12/2009 |
| JP | 2010015811 | A | 1/2010 |
| JP | 2010034262 | A | 2/2010 |
| JP | 2010147025 | A | 7/2010 |
| JP | 2010176856 | A | 8/2010 |
| JP | 4615479 | B2 | 10/2010 |
| JP | 2010251465 | A | 11/2010 |
| JP | 2011061157 | A | 3/2011 |
| JP | 4730717 | B2 | 4/2011 |
| JP | 2011103353 | A | 5/2011 |
| JP | 2011181650 | A | 9/2011 |
| KR | 1020090104520 | A | 10/2009 |
| KR | 200454488 | Y1 | 7/2011 |
| KR | 101064089 | B1 | 9/2011 |
| KR | 101064793 | B1 | 9/2011 |
| KR | 1020110115272 | A | 10/2011 |
| KR | 2020110010409 | U | 11/2011 |
| SG | 172560 | A1 | 7/2011 |
| TW | 200816517 | | 9/1995 |
| TW | I306064 | | 11/1995 |
| TW | M309521 | U | 11/1995 |
| TW | M364180 | U1 | 9/2009 |
| WO | 2004055433 | A1 | 7/2004 |
| WO | 2008037940 | A1 | 4/2008 |
| WO | 2008070983 | A1 | 6/2008 |
| WO | 2008087572 | A1 | 7/2008 |
| WO | 2010002158 | A3 | 7/2010 |
| WO | 2011093174 | A1 | 8/2011 |
| WO | 2011098463 | A1 | 8/2011 |

OTHER PUBLICATIONS

Chinese Patent No. 102278728 (A), Publication Date: Dec. 14, 2011, Abstract Only, 1 Page.

Chinese Patent No. 201110485 (Y); Publication Date: Sep. 3, 2008; Abstract Only; 1 Page.

Chinese Patent No. 201133600 (Y); Publication Date: Oct. 15, 2008; Abstract Only; 1 Page.

Chinese Patent No. 201141573 (Y); Publication Date: Oct. 29, 2008; Abstract Only; 1 Page.

Chinese Patent No. 201437917 (U); Publication Date: Apr. 14, 2010; Abstract Only; 1 Page.

Chinese Patent No. 201462624 (U); Publication Date: May 12, 2010; Abstract Only; 1 Page.

Chinese Patent No. 201819170 (U); Publication Date: May 4, 2011; Abstract Only; 1 Page.

English Abstract of International Publication No. 2004055433 A1; Date of PUblication Jul. 1, 2004; 2 pages.

French Patent No. 2926926 (A1); Publication Date: Jul. 31, 2009; Abstract Only; 2 Pages.

French Patent No. 2926947 (A1); Publication Date: Jul. 31, 2009; Abstract Only; 2 Pages.

German Patent No. 102008031432 (A1); Machine Translation Retrieved Mar. 8, 2012; 1 Page.

German Patent No. 102010026344 (A1); Publication Date: Jan. 12, 2012; Machine Translation; 11 Pages.

German Patent No. 202010005528 (U1); Publication Date: Sep. 16, 2010; Machine Translation; 9 Pages.

International Publication No. 2010002158 (A2); Publication Date: Jan. 7, 2010; Abstract Only; 1 Page.

International Publication No. 2011093174 (A1); Publication Date: Aug. 4, 2011; Abstract Only; 2 Pages.

International Search Report of the International Searching Authority; International Application No. PCT/IB2013/056821; International Filing date Aug. 22, 2013; dated Feb. 17, 2014; 5 pages.

(56) References Cited

OTHER PUBLICATIONS

Japanese Patent No. 2008135260 (A); Publication Date: Jun. 12, 2008; Abstract Only; 2 Pages.
Japanese Patent No. 2008204844 (A); Publication Date: Sep. 4, 2008; Abstract Only; 2 Pages.
Japanese Patent No. 2008218761 (A); Publication Date: Sep. 18, 2008; Abstract Only; 2 Pages.
Japanese Patent No. 2008235867 (A); Publication Date: Oct. 2, 2008; Abstract Only; 2 Pages.
Japanese Patent No. 2008293692 (A); Publication Date: Dec. 4, 2008; Abstract Only; 2 Pages.
Japanese Patent No. 2009146706 (A); Publication Date: Jul. 2, 2009; Abstract Only; 2 Pages.
Japanese Patent No. 2009187707 (A); Publication Date: Aug. 20, 2009; Abstract Only; 2 Pages.
Japanese Patent No. 2009283406 (A); Publication Date: Dec. 3, 2009; Abstract Only; 2 Pages.
Japanese Patent No. 2010015811 (A); Publication Date: Jan. 21, 2010; Abstract Only; 2 Pages.
Japanese Patent No. 2010034262 (A); Publication Date: Feb. 12, 2010; Abstract Only; 2 Pages.
Japanese Patent No. 2010176856 (A); Publication Date: Aug. 12, 2010; Abstract Only; 2 Pages.
Japanese Patent No. 2010251465 (A); Publication Date: Nov. 4, 2010; Abstract Only; 2 Pages.
Japanese Patent No. 2011061157 (A); Publication Date: Mar. 24, 2011; Abstract Only; 2 Pages.
Japanese Patent No. 2011103353 (A); Publication Date: May 26, 2011; Abstract Only; 2 Pages.
Japanese Patent No. 2011181650 (A); Publication Date: Sep. 15, 2011; Abstract Only; 2 Pages.
Japanese Patent No. 4615479 (B2); Publication Date: Jan. 19, 2011; Abstract Only; 2 Pages.
Japanese Patent No. 4730717 (B2); Publication Date: Jul. 20, 2011; Abstract Only; 1 Page.
Korean Patent No. 101064089 (B1); Publication Date: Sep. 8, 2011; Machine Translation; 14 Pages.
Korean Patent No. 101064793 (B1); Publication Date: Sep. 14, 2011; Abstract Only; 1 Page.
Korean Patent No. 1020110115272 (A); Publication Date: Oct. 21, 2011; Machine Translation; 5 Pages.
Korean Patent No. 200454488 (Y1); Publication Date: Jul. 7, 2011; Machine Translation; 13 Pages.
Korean Patent No. 20090104520 (A); Publication Date: Oct. 6, 2009; Abstract Only; 1 Page.
Taiwan Patent No. 200816517 (A); Publication Date: Apr. 1, 2008; Abstract Only; 1 Page.
Taiwan Patent No. I306064 (B); Publication Date: Feb. 11, 2009; Abstract Only; 1 Page.
Written Opinion of the International Preliminary Examining Authority; International Application No. PCT/IB2013/056821; dated Sep. 9, 2014; 5 Pages.
Written Opinion of the International Searching Authority; International Application No. PCT/IB2013/056821; International Filing date Aug. 22, 2013; dated Feb. 17, 2014; 5 pages.
Chinese Patent No. 201081206(Y); Date of Publication: Jul. 2, 2008; Machine Translation; 3 Pages.
Chinese Patent No. 201173467(Y); Date of Publication: Dec. 31, 2008; Machine Translation; 10 Pages.
European Patent No. 0770817(A1); Date of Publication: May 2, 1997; Machine Translation; 4 Pages.
German Patent No. 3903868(C1); Date of Publication: Apr. 19, 1990; Machine Translation; 4 Pages.

* cited by examiner

HEAT DISSIPATING SYSTEM FOR A LIGHT, HEADLAMP ASSEMBLY COMPRISING THE SAME, AND METHOD OF DISSIPATING HEAT

BACKGROUND

Disclosed herein is a heat dissipating system, specifically, a heat dissipating system for a light source, and more specifically, a heat dissipating system for a light emitting diode (LED) module of a vehicle.

Light emitting diodes (LEDs) are currently used as replacements for incandescent light bulbs and fluorescent lamps. LEDs are semiconductor devices that emit incoherent narrow-spectrum light when electrically biased in the forward direction of their PN junctions, and are thus referred to as solid-state lighting devices. The high power LED light devices produce considerable amount of heat, which may cause performance degradation or even damage if the heat is not removed from the LED chips efficiently.

In an LED light device, the core is a LED chip mounted on a substrate. Sometimes a transparent covering over the LED chip can serve as a lens for modifying the direction of the emitted light.

In general, LED chips in an automotive headlamp need to be maintained below certain temperatures as an increased temperature of the chip can reduce the life of the LED exponentially, and can adversely affect the light output of the LED light device. Maintaining such a reduced temperature is a challenge, as a significant amount of heat from the engine compartment is generated during vehicle operation in addition to the heat produced by the LED lighting device itself. Typically, cooling of a LED chip is achieved by using a large aluminum die cast heat sink system on the LED assembly. However, conventional heat sink systems can occupy a significant amount of space inside the headlamp assembly and thus add excessive weight to the headlamp assembly.

Moreover, in automotive headlamps, the beam patterns may need to be adjusted depending upon the requirements of the automotive vehicle. These adjustments, also referred to as "auto leveling" of the headlamp is typically performed with the use of a small electric motor. In adaptive lighting, the beam can be adjusted continuously based on the speed of the vehicle and also based on the steering position. In such cases, if the headlamp assembly is heavy, the response time could be high or heavier motors may need to be employed to affect the proper adjustments. Actually, as much as 400 grams (g) of die cast heat sink is being used in some vehicle headlamps.

Thus, there is a continual need for LED headlamp assemblies having reduced weight, as well as effective methods of dissipating heat away from a LED chip of a LED assembly that could enable the use of smaller, lighter weight components and/or the elimination of some thermally conductive components in the headlamp assembly.

BRIEF DESCRIPTION

Embodiments disclosed herein are heat dissipating systems, LED headlamp assemblies comprising the same, as well as methods of dissipating heat away from the LED modules.

In an embodiment, a heat dissipating system for a light can comprise: a light source comprising an LED; a reflector adjacent the LED; a housing around the LED module; and a flexible conductive connector attached at one end to a heat sink and at another end to the light source. The connector is configured to conduct heat away from the light source and to the heat sink. The heat sink is located remote from the light source.

In another embodiment, a heat dissipating system for a light can comprise: a light source comprising an LED; a reflector adjacent the LED; a housing around the LED module; and a thermally conductive connector attached at one end to a heat sink and at another end to the light source. The thermally conductive connector is configured to conduct heat away from the light source and to the heat sink, and enables beam pattern adjustment without movement of the heat sink. The heat sink is located remote from the light source.

In yet another embodiment, a vehicle headlamp heat dissipating system can comprise: a vehicle headlamp comprising a LED module and a reflector in a housing; a heat sink located in the vehicle external to the housing; and a flexible conductive connector connected at one end to the heat sink and at another end to the LED module, and configured to conduct heat away from the LED module and to the heat sink.

In an embodiment, a method of dissipating heat away from a LED module can comprise: conducting heat from the LED module through a flexible conductive connector to a heat sink, wherein a lamp comprises the LED module, a housing, and a reflector, and wherein the heat sink is located external to the LED housing.

The above described and other features are exemplified by the following figures and detailed description.

BRIEF DESCRIPTION OF THE DRAWINGS

Refer now to the figures, which are exemplary embodiments, and wherein the like elements are numbered alike.

DETAILED DESCRIPTION

It has herein been determined how to achieve effective heat dissipation from a LED (light emitting diode) of a headlamp assembly by transmitting heat away from the chip with use of a flexible conductor, such as a flexible wire, to a heat sink located external to the headlamp assembly, as further described below. As a result of embodiments disclosed herein, the LED chip temperature can be reduced thereby increasing the life of the LED.

With use of the heat dissipation techniques disclosed herein, some thermally conductive components typically present in headlamp assemblies are not required. Thus, the headlamp assembly can comprise a structure of reduced weight in comparison to conventional assemblies thus enabling more responsive adaptive lighting. Moreover, vertical and horizontal aiming movements also can be achieved with a motor smaller in comparison to larger and heavier motors typically employed. In conventional designs, the heat sink is part of the LED mounting structure. Therefore, when the structure is activated (e.g., to change the beam position), the entire structure (with the heat sink) moves; hence it is a bulky, heavy structure.

In the present design, the heat sink is remote from the light source such that the beam can be adjusted without moving the entire heat sink. Hence, a much lighter structure is moved. Actually, in the present design, the body in white (BIW) can be used to dissipate heat, thus eliminating the need for a separate heat sink on the LED mounting structure. Here, the LED mounting structure comprises a connector, and is free of a heat sink (e.g., an element comprising fins). Also, as a result of the efficient heat dissipation, a more compact LED headlamp is possible.

Further advantages of embodiments disclosed herein include the potential of, e.g., using a standard heat sink for various configurations of a headlamp assembly; reducing LED mounting metal mass and/or employing a non-metal mounting material, such as plastic or other suitable material; having integrated molded heat sinks in the headlamp housing; and/or other integration opportunities such as employing an all plastic LED mounting bracket.

Figure 1:
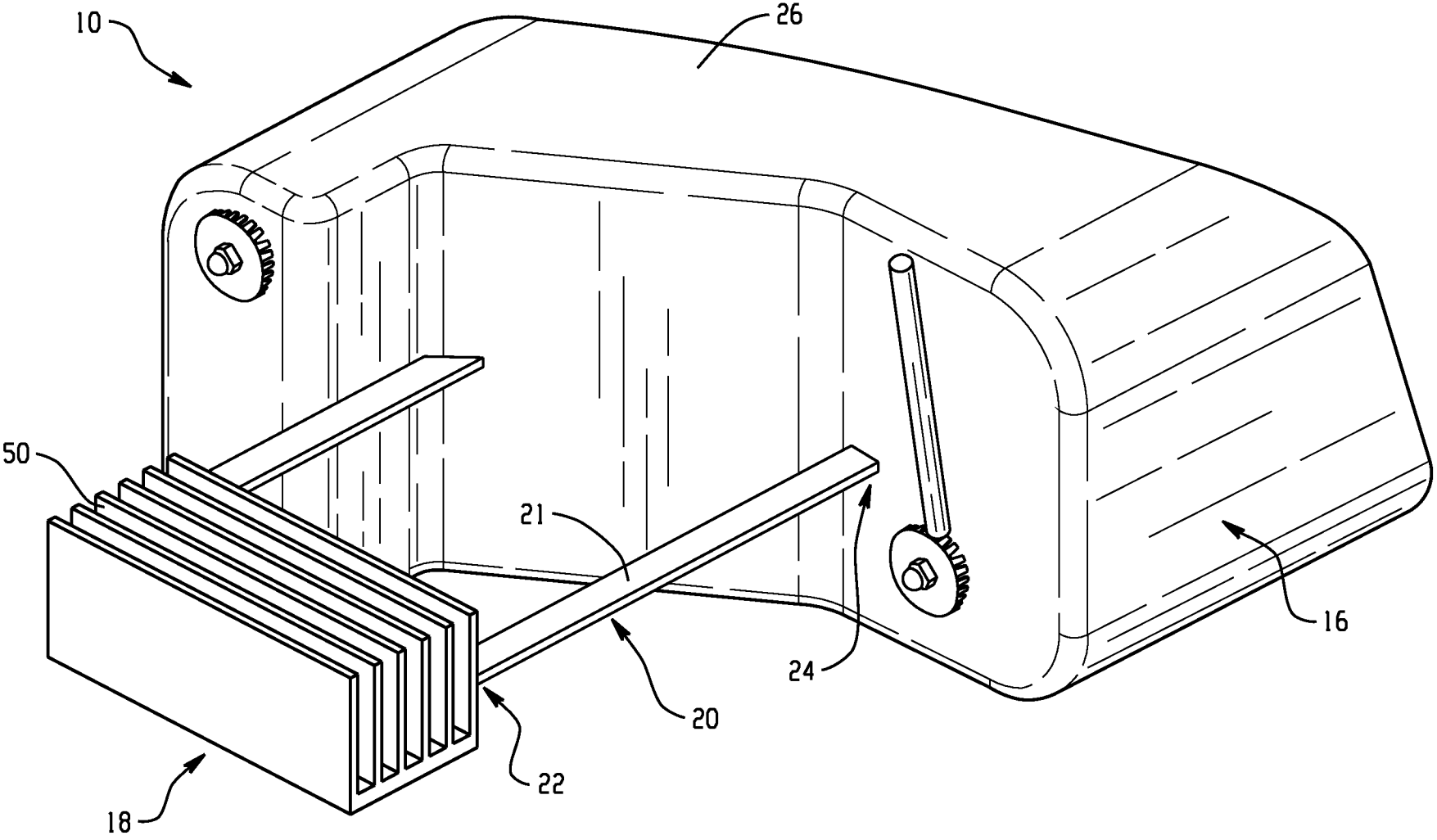
FIG. 1 is a back perspective view of a light emitting diode (LED) headlamp with a heat dissipating system configured for a light emitting diode (LED) module of a vehicle.
Figure 2:
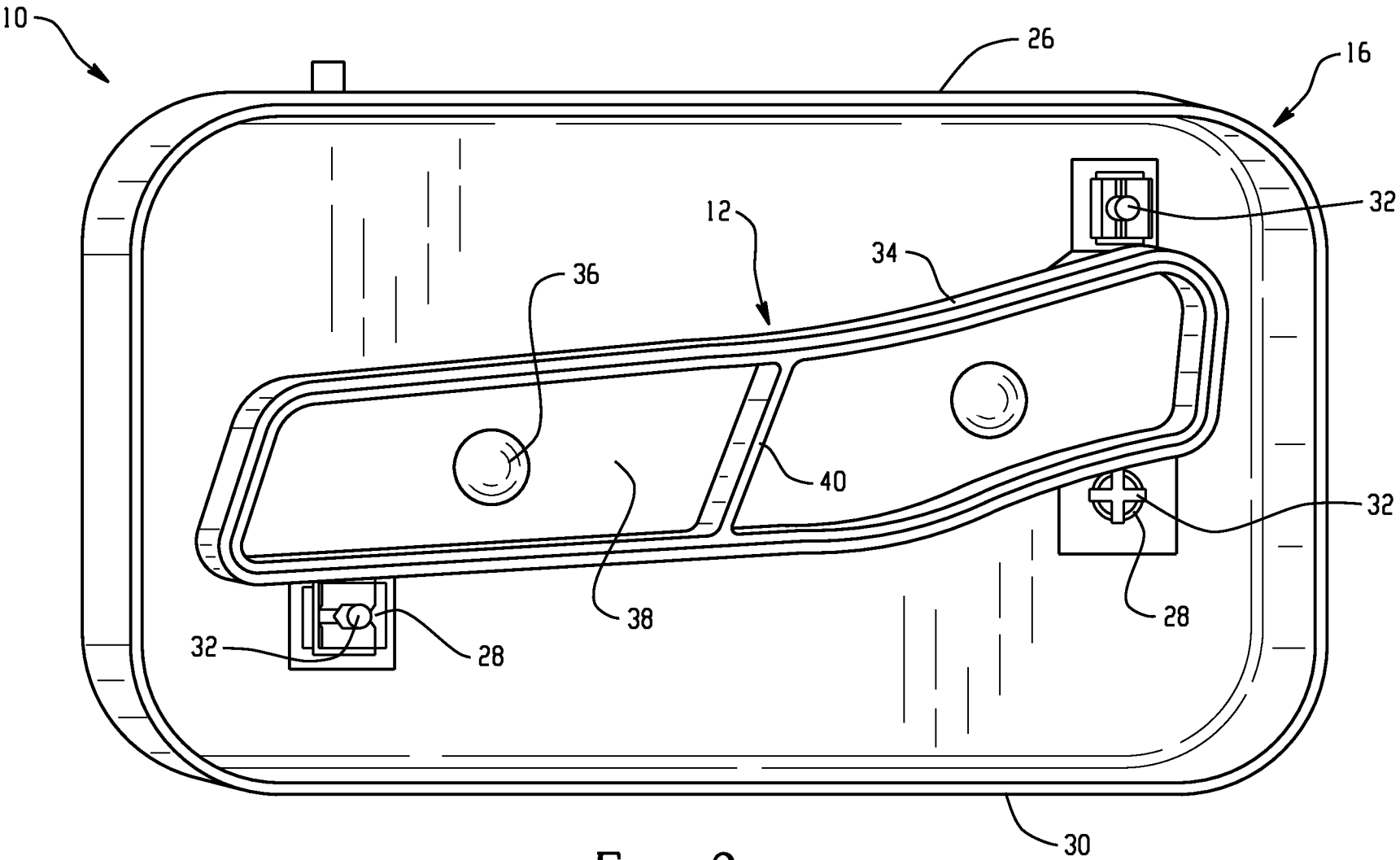
FIG. 2 is a front perspective view of a light emitting diode (LED) headlamp with a heat dissipating system of FIG. 1.
Figure 3A:
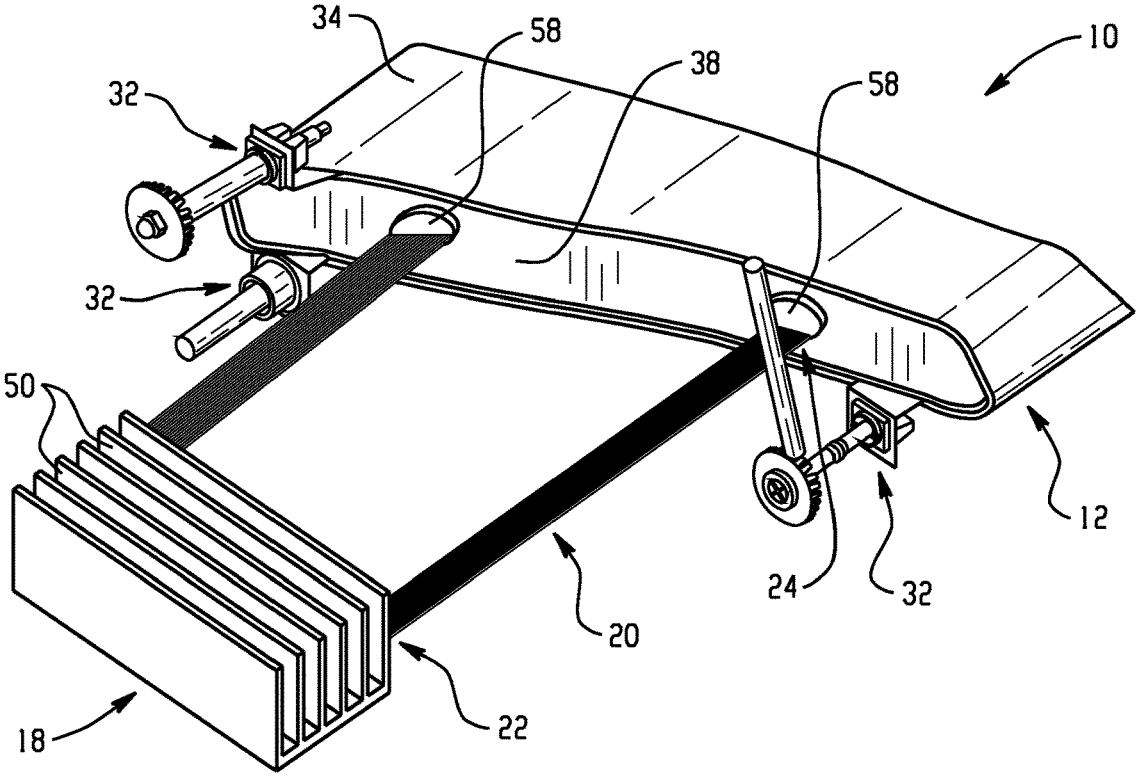
FIG. 3A is a perspective view of a heat dissipating system configured for a LED module of a vehicle (outer housing of headlamp not shown).
Figure 3B:
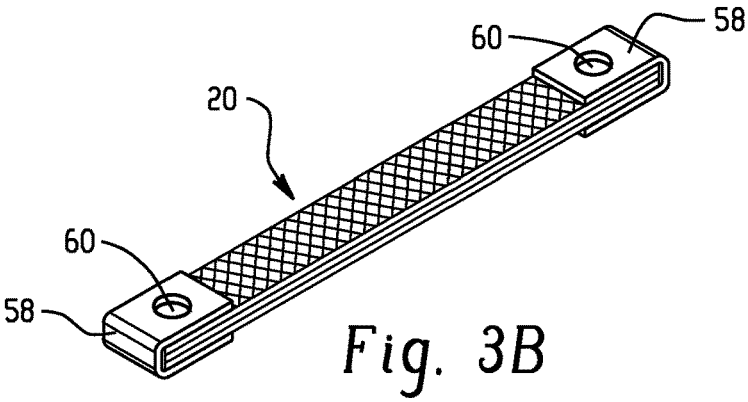
FIG. 3B is a perspective view of an example of a braided metal wire connector.
Figure 3C:
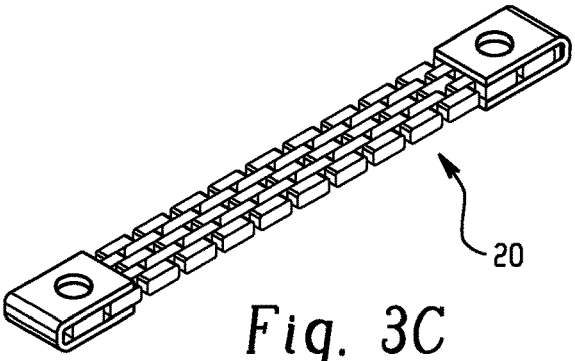
FIG. 3C is a plan view of an example of a twisted metal wire (rope) connector.
Figure 4:
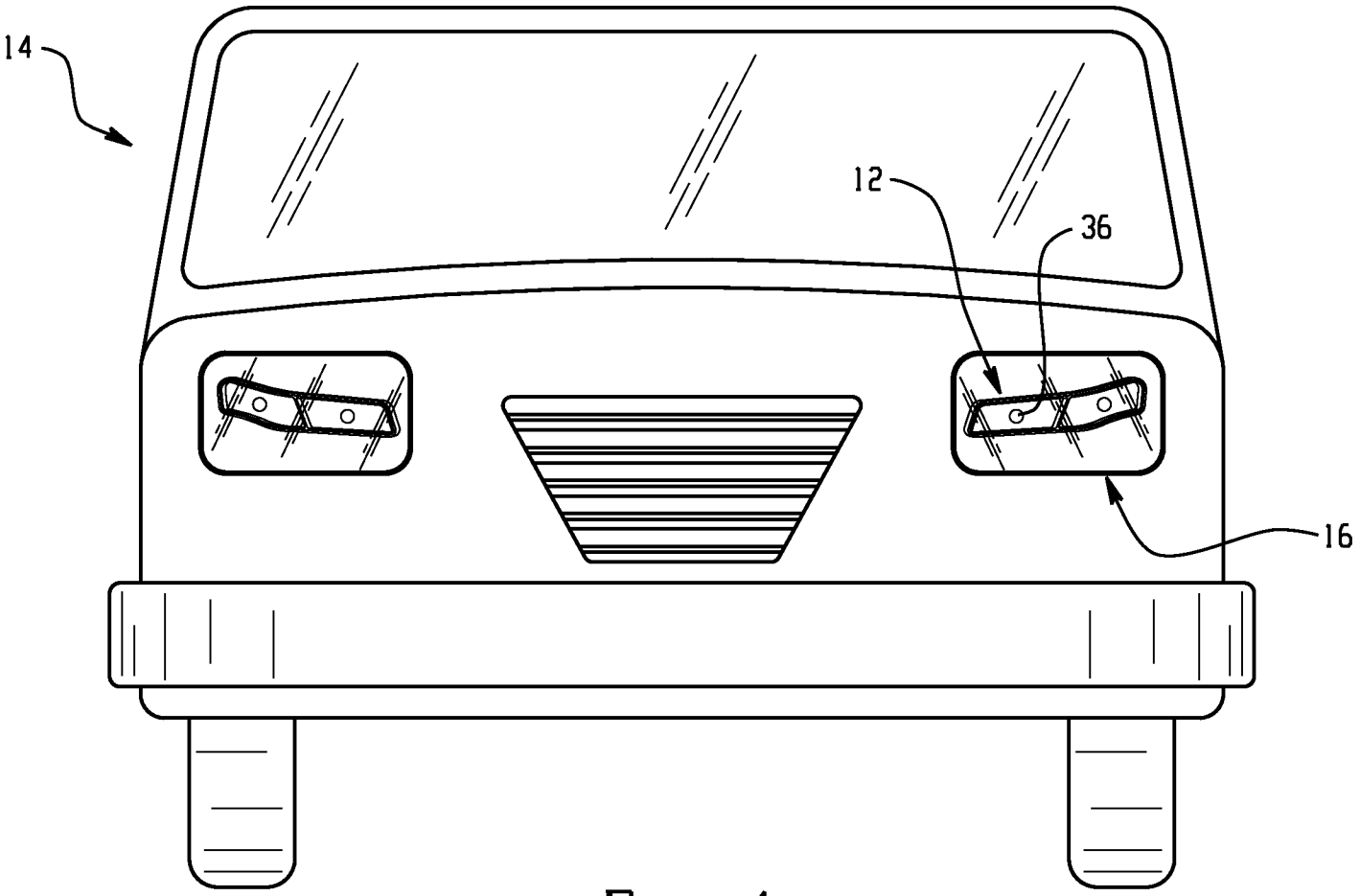
FIG. 4 is a front perspective view of a LED module mounted in a headlamp of a vehicle.

Referring now to the figures, FIG. 1 depicts a back perspective view of a heat dissipating system 10 configured for a light emitting diode (LED) module 12 (shown, e.g., in FIGS. 2 and 3) of a vehicle 14 (best seen in FIG. 4). FIG. 2 depicts the front perspective view of the heat dissipating system 10 of FIG. 1.

Heat dissipating system 10 can comprise LED module 12 mounted in a headlamp 16 of vehicle 14 such as an automobile as shown, for example, in FIG. 4. The heat dissipating system 10 can further comprise a heat sink 18 located in the vehicle 14 external to the headlamp 16 and at a distance from the LED module 12, as shown in FIGS. 1 and 3. At least one flexible conductive connector 20 can be connected at one end 22 to the heat sink 18 and at another end 24 to the LED module 12, and configured to conduct heat away from the LED module 12 and to the heat sink 18, as further described below.

The headlamp 16 can comprise an outer housing 26, as shown in FIGS. 1 and 2, in which the LED module 12 can be mounted. The outer housing 26 is shown in FIGS. 1 and 2 as having a generally elongated rectangular shape. However, it will be appreciated that various shapes and sizes are contemplated as desired depending upon, e.g., the particular vehicle 14 employed including size of the vehicle, output lighting needed, and so forth. Outer housing 26 can be made of any desirable material, especially plastics including polycarbonate, polyolefins (such as polypropylene), and so forth, as well as combinations comprising at least one of the foregoing. As shown in FIG. 2, outer housing 26 and LED module 12 can comprise adjustment mechanism (e.g., slots 28 into which adjustment element(s) 32 can be inserted) for mounting of the LED module 12 to the outer housing 26. The slots and adjustment element size and geometry depends upon the translation and rotation movement of LED module required for adjustment of beam, and can be disposed in any location that enables the LED module to be securely attached to the LED housing in a desired location and orientation. For example, the LED module 12 can be mounted to the outer housing 26 with use of adjustment element(s) 32, which are shown in FIGS. 1, 2, and 3.

Figure 10:
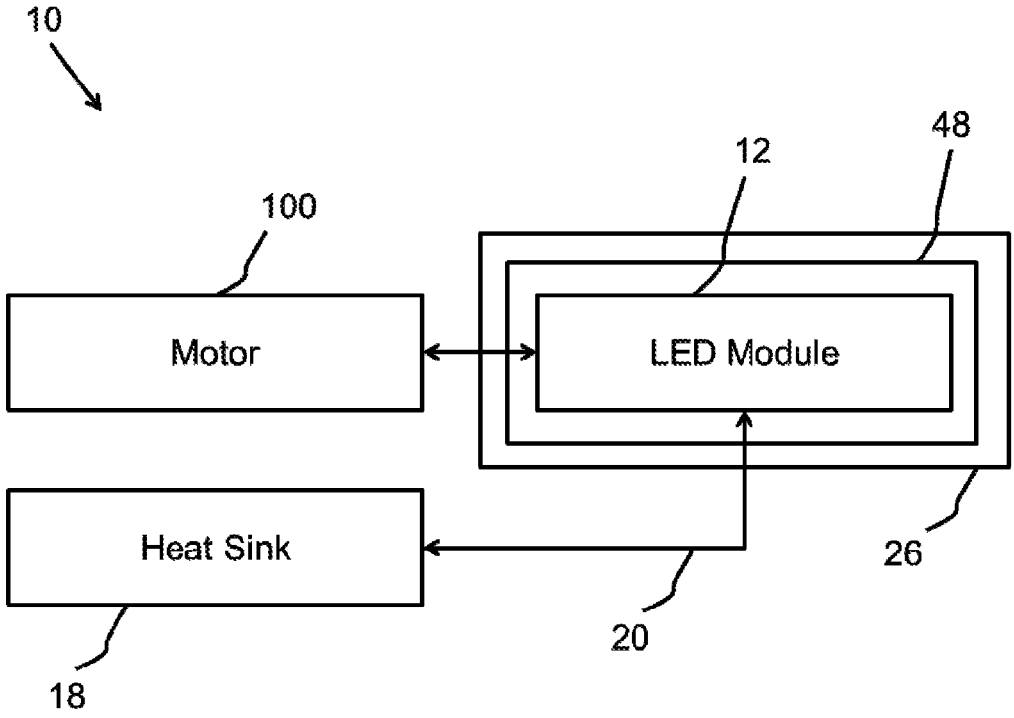
FIG. 10 is a schematic illustration of a heat dissipating system where an LED module is connected to a motor which is configured to move the LED while not moving the heat sink.

It is further noted that the outer housing 26 can be fixed while allowing movement of the LED module 12 and/or any reflector 48 or lens thereof. Therefore, the LED module 12 can be connected to a motor 100 (e.g., FIG. 10)—so as to allow adjustment of the light beam produced by the LED module 12.

The LED module 12 can be attached to a remote heat sink 18 (e.g., a heat sink located away from the LED module 12 and outer housing 26). The connection between the LED module 12 and heat sink 18 is not rigid, i.e., flexible connector 20 allows the heat sink 18 to be located remote from the LED module 12. Since the heat sink is remote to the LED module, the design is of reduced weight which can be more easily controlled with motor(s) located in the vehicle 14. The flexible connection afforded by connector 20 can allow adjustment/movement of component(s) of the LED module 12 to adjust beam patterns emitted therefrom.

The LED module 12 can comprise a shell 34. The shell 34 can be configured to receive one or more light emitting diodes (LEDs) 36 which can optionally be located on a substrate 38. The shell 34 can be made of any desirable material, such as plastic including polycarbonates, and in any desirable shape and size depending upon, e.g., the type and size of vehicle, number of LEDs employed, and so forth. For example, the shell can have a rounded or polygonal geometry, e.g., conical, elliptical, open rectangular box shaped, and so forth. FIGS. 2 and 3 depict a generally elongated rectangular shaped shell 34, while FIGS. 5-9 illustrate a truncated conical shaped reflector 48.

A reflector 48 assists in directing light from the LED in the desired direction. (see FIG. 5) The reflector 48 can comprise a shell 34 with a reflective coating on an inner surface thereof, such as a metallic coating. Optionally, the reflector 48 can move relative to the LED.

The LED module 12 further comprises one or more LEDs 36, specifically, two or more LEDs 36. If multiple LEDs 36 are employed, they can optionally be separated by, e.g., divider 40, although such separation is not required but may enhance the aesthetics of the design. (see FIG. 2) Due to the desire for effective luminance in automotive headlamp lighting, typically more than one LED 36 will be employed because LEDs are known to be significantly less luminous than, e.g., tungsten halogen filaments.

Figure 5:
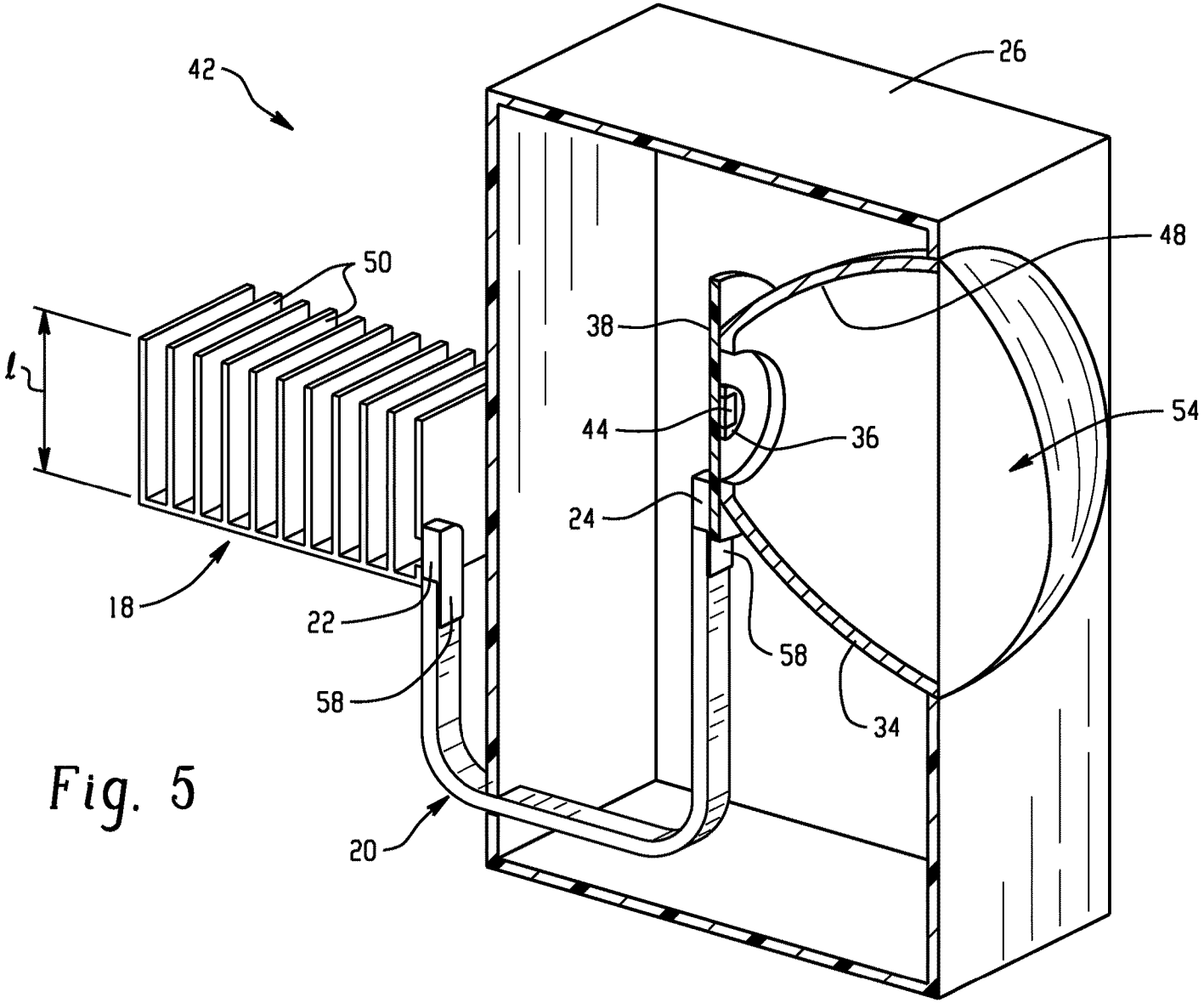
FIG. 5 is a perspective view of simplified architecture of a LED headlamp assembly comprising a copper strip as a heat dissipation mechanism.

The LED(s) can be located on the same or different substrates 38. The substrate 38 can various materials such as aluminum, sheet metal, and/or a printed circuit board (PCB) (e.g., epoxy) upon which LED chip(s) 44 of a LED can be positioned, as shown in FIG. 5. Optionally the substrate can be an epoxy, aluminum, copper, magnesium, as well as combinations comprising at least one of the foregoing.

From the battery of a vehicle 14, current can be supplied from the vehicle 14 to the LED module 12 causing the LED 36 on the substrate 38 to emit light. (see FIG. 4) This light can then be projected outward from the headlamp 16 with use of reflector 48 in the headlamp 16. As the LED emits light, it also creates heat. The heat can be removed from the LED with the heat sink 18 (see FIGS. 1 and 3).

The heat sink 18 (which can be a standard heat sink comprising fins, and/or can be the body in white (e.g., the thermally conductive structure of the vehicle) is located external to the headlamp 16. Desirably, the heat sink 18 is located a distance from the LED module 12, with the specific distance readily determined based upon the packaging space available, the heat dissipation efficiency of the connector, and the heat sink. Thus, heat sink 18 is not in direct contact (i.e., is not in physical contact) with the LED module 12 and optionally not in direct contact with the outer housing 26. The contact between the heat sink 18 and the LED module 12 is via the connector 20. The actual distance between the light source (e.g., LED) and the heat sink can be greater than or equal to 10 mm.

In some embodiments, the heat sink 18 can be directly attached to (i.e., in physical contact with) the outer housing 26. If attached to the outer housing, the heat sink and outer housing could be formed in a multishot injection molding wherein the housing could be formed from the thermally conductive plastic material such as carbon fiber composite, Konduit* resin (commercially available from SABIC Innovative Plastics), and so forth. Meanwhile, the heat sink could be formed from a thermally conductive plastic and/or a metal. Hence, the heat sink could be integrally attached to the housing via the molding process, or could be formed separately and attached with an adhesive and/or mechanical element(s) (such as screws, studs, bolts, rivets, snap connectors, and so forth), as well as combinations comprising at least one of the foregoing. Optionally, e.g., if the housing is large (e.g., has sufficient volume to enable adequate heat dissipation for the given application), the heat sink 18 can be located within the housing, but remote from the light source (e.g., LED). In other words, even in this embodiment, the heat sink 18 would connect to the light source via the connector 20.

Heat sink 18 can be made of a material having a thermal conductivity of greater than or equal to 50 watts per meter Kelvin (W/m·K), specifically, greater than or equal to 100 W/m·K, more specifically, greater than or equal to 150 W/m·K. Some possible materials include metals, conductive plastic, and a combination comprising at least one of the foregoing. Possible thermally conductive materials (and thermally conductive fillers for the plastic) include aluminum (e.g., AlN (aluminum nitride)), BN (boron nitride), $MgSiN_2$ (magnesium silicon nitride), SiC (silicon carbide), graphite, or a combination comprising at least one of the foregoing. For example, ceramic-coated graphite, expanded graphite, graphene, carbon fiber, carbon nanotubes (CNT), graphitized carbon black, or a combination comprising at least one of the foregoing. Typically, heat sink 18 comprises a thermally conductive metal such as copper and/or aluminum.

The polymer used in the thermally conductive plastic can be selected from a wide variety of thermoplastic resins, blend of thermoplastic resins, thermosetting resins, or blends of thermoplastic resins with thermosetting resins, as well as combinations comprising at least one of the foregoing. The polymer may also be a blend of polymers, copolymers, terpolymers, or combinations comprising at least one of the foregoing. The organic polymer can also be an oligomer, a homopolymer, a copolymer, a block copolymer, an alternating block copolymer, a random polymer, a random copolymer, a random block copolymer, a graft copolymer, a star block copolymer, a dendrimer, or the like, or a combination comprising at least one of the foregoing. Examples of the organic polymer include polyacetals, polyolefins, polyacrylics, poly(arylene ether) polycarbonates, polystyrenes, polyesters (e.g., cycloaliphatic polyester, high molecular weight polymeric glycol terephthalates or isophthalates, and so forth), polyamides (e.g., semi-aromatic polyamid such as PA4.T, PA6.T, PA9.T, and so forth), polyamideimides, polyarylates, polyarylsulfones, polyethersulfones, polyphenylene sulfides, polyvinyl chlorides, polysulfones, polyimides, polyetherimides, polytetrafluoroethylenes, polyetherketones, polyether etherketones, polyether ketone ketones, polybenzoxazoles, polyphthalides, polyacetals, polyanhydrides, polyvinyl ethers, polyvinyl thioethers, polyvinyl alcohols, polyvinyl ketones, polyvinyl halides, polyvinyl nitriles, polyvinyl esters, polysulfonates, polysulfides, polythioesters, polysulfones, polysulfonamides, polyureas, polyphosphazenes, polysilazanes, styrene acrylonitrile, acrylonitrile-butadiene-styrene (ABS), polyethylene terephthalate, polybutylene terephthalate, polyurethane, ethylene propylene diene rubber (EPR), polytetrafluoroethylene, fluorinated ethylene propylene, perfluoroalkoxyethylene, polychlorotrifluoroethylene, polyvinylidene fluoride, or the like, or a combination comprising at least one of the foregoing organic polymers. Examples of polyolefins include polyethylene (PE), including high-density polyethylene (HDPE), linear low-density polyethylene (LLDPE), low-density polyethylene (LDPE), mid-density polyethylene (MDPE), glycidyl methacrylate modified polyethylene, maleic anhydride functionalized polyethylene, maleic anhydride functionalized elastomeric ethylene copolymers (like EXXELOR VA1801 and VA1803 from ExxonMobil), ethylene-butene copolymers, ethylene-octene copolymers, ethylene-acrylate copolymers, such as ethylene-methyl acrylate, ethylene-ethyl acrylate, and ethylene butyl acrylate copolymers, glycidyl methacrylate functionalized ethylene-acrylate terpolymers, anhydride functionalized ethylene-acrylate polymers, anhydride functionalized ethylene-octene and anhydride functionalized ethylene-butene copolymers, polypropylene (PP), maleic anhydride functionalized polypropylene, glycidyl methacrylate modified polypropylene, and a combination comprising at least one of the foregoing polymers.

Examples of blends of thermoplastic resins include acrylonitrile-butadiene-styrene/nylon, polycarbonate/acrylonitrile-butadiene-styrene, acrylonitrile butadiene styrene/polyvinyl chloride, polyphenylene ether/polystyrene, polyphenylene ether/nylon, polysulfone/acrylonitrile-butadiene-styrene, polycarbonate/thermoplastic urethane, polycarbonate/polyethylene terephthalate, polycarbonate/polybutylene terephthalate, thermoplastic elastomer alloys, nylon/elastomers, polyester/elastomers, polyethylene terephthalate/polybutylene terephthalate, acetal/elastomer, styrene-maleicanhydride/acrylonitrile-butadiene-styrene, polyether etherketone/polyethersulfone, polyether etherketone/polyetherimide polyethylene/nylon, polyethylene/polyacetal, or the like.

Examples of thermosetting resins include polyurethane, natural rubber, synthetic rubber, epoxy, phenolic, polyesters, polyamides, silicones, or the like, or a combination comprising at least one of the foregoing thermosetting resins. Blends of thermoset resins as well as blends of thermoplastic resins with thermosets can be utilized.

For example, the polymer that can be used in the thermally conductive material can be a polyarylene ether. The term poly(arylene ether) polymer includes polyphenylene ether (PPE) and poly(arylene ether) copolymers; graft copolymers; poly(arylene ether) ionomers; and block copolymers of alkenyl aromatic compounds with poly(arylene ether)s, vinyl aromatic compounds, and poly(arylene ether), and the like; and combinations including at least one of the foregoing.

Optionally, the connector 20 can comprise a sheath 21. (see FIG. 1) The sheath 21 can surround the connector such that the dissipation of heat from the connector 20 to the surrounding environment is minimized Hence, the sheath 21 can comprise a thermally insulative material. Possible materials include any of the above plastics that do not comprise the electrically conductive filler. Some examples of materials for the sheath (e.g., sleeve around the connector) include plastics, glass fiber, and meta-aramid materials (e.g., NOMEX* flame resistant material commercially available from DuPont), as well as combinations comprising at least one of the foregoing.

The design and shape of heat sink 18 are dependent upon factors such as, e.g., the specific application, heat transfer needed, location of the heat sink, and available space. Hence, heat sink 18 can be polygonal and/or rounded. Generally the heat sink comprises fins or other elements to increase the surface area and therefore enhance heat dissipation. For example, the heat sink can have a rectangular cross-sectional geometry, such as shown in FIG. 1. Heat sink 18 can include heat dissipating elements 50 (e.g., fins). As shown in FIG. 1, the fins 50 can be located on the outer wall(s) of the heat sink 18 and extend outward from the body of the heat sink 18. For a round heat sink, the fins can extend radially. Heat dissipating elements 50 are located in a spaced apart relationship so as to enable heat dissipation to the surrounding environment (e.g., air). For example, the length ("l") of each heat dissipating element 50 is based upon the amount of heat dissipation desired and the thermal conductivity of the material employed.

The heat sink 18 is connected to the LED module, e.g., to the substrate 36, with a flexible conductive connector 20. The connector 20 conducts heat away from the LED module 12 and to the heat sink 18.

For example, with reference to the simplified architecture of a LED headlamp assembly 42 shown in FIG. 5, during functioning of a headlamp, power is directed to the headlamp assembly 42 and to the LED module 12 such that LED 36 produces light that passes through lens 54 or is reflected by reflector 48 and passes through lens 54. In addition to emitting light, the LED generates heat which heats the substrate 38, (e.g., PBC with LED chip 44) mounted or received thereon. The conductor 20 then moves heat away from substrate 36 to outside of the housing 26 and into the heat sink 18.

Flexible connector 20 can be secured to the substrate 38 and the heat sink 18 as shown, e.g., in FIGS. 3A, 3B, and 5, with use of securing mechanisms 58 such as a mechanical mechanism (e.g., snaps, rivets, bolts, screws, clamps, keyhole/slot connection, stud, weld, braze, solder, etc.) and/or chemical mechanism (e.g., adhesive), as well as a combination comprising at least one of the foregoing. More specifically, the securing mechanisms 58 attach to the heat sink 18 and LED module 12 with a thermally conductive medium. Optionally, a TIM (thermal interface material) can be used in any air gaps between the connector and the LED module 12 and/or the heat sink 18, e.g., for better heat conduction. For example, flexible connector 20 can comprise a metal attachment member at each end thereof, configured at one end 22 to be attached to the heat sink 18 and configured at the other end 24 to be attached to the LED module 12. The metal attachment member 58 can comprise an opening 60 therethrough configured to receive a securing device (e.g., screw, rivet, stud, pin, snap element, etc.). Alternatively, or in addition, the connector can be attached to the LED module 12 and/or the heat sink 18 via brazing/welding, soldering, and so forth.

The flexible connector 20 can comprise a thermally conductive material. The degree of thermal conductivity of the material needed to withdraw the heat from the light source is dependent upon the power of the light source. For example, for low wattage applications, e.g., a wattage of less than 20 watts (W) (specifically, 5 W to 10 W), the thermally conductive material is chosen to have a thermal conductivity of greater than or equal to 4 W/m·K, specifically, greater than or equal to 10 W/m·K, more specifically, greater than or equal to 20 W/m·K, and yet more specifically, greater than or equal to 50 W/m·K. For high wattage applications, e.g., a wattage of greater than or equal to 20 watts (W) (specifically, greater than or equal to 25 W, more specifically, greater than or equal to 30 W, and yet more specifically, greater than or equal to 40 W) the thermally conductive material can have a thermal conductivity of greater than or equal to 30 W/m·K, specifically, greater than or equal to 50 W/m·K, more specifically, greater than or equal to 100 W/m·K, and yet more specifically, greater than or equal to 200 W/m·K. Possible thermally conductive materials include materials such as those used for the heat sink. Specifically, the connector 20 can comprise metal (such as copper, aluminum, tin, steel, magnesium, and so forth), thermally conductive plastic (e.g., plastic comprising conductive fillers), and combinations comprising at least one of the foregoing materials, with the particular material dependent upon the desired thermal conductivity.

The flexible connector 20 can be any form that allows adjustment of the beam pattern while not moving the heat sink 18. The adjustment can be by movement of the light source, e.g., by movement of the light source assembly. In other words, the beam pattern can be adjusted without moving the heat sink because the connector allows sufficient flexibility to adjust the beam pattern while retaining the heat sink stationary, and without moving after the load is removed (e.g., so that the adjusted beam pattern remains in its adjusted position). For example, the flexible connector can move by greater than or equal to 2 mm via application of a load (without movement of the heat sink), wherein, when the load is removed, the light source (and hence the beam pattern) remains in the adjusted position. In other words, the light source does not return to its original position without the applicant of another load. It is noted that smaller motors (for beam pattern adjustment) are desirable for use in vehicles, e.g., for weight and power consumption reasons. Generally the motor used to adjust the beam pattern will apply a force of less than 20 Newtons (N). Desirably, the motor will apply a force of less than or equal to 10 N, specifically, less than or equal to 7 N, more specifically, less than or equal to 5 N, and even less than or equal to 1 N. When in use in a vehicle, under the given load, the flexible connector can deflect greater than or equal to 2 mm, adjusting the beam pattern, and, once the load is removed, the beam pattern will not change until another load is applied.

Various sizes, shapes, and textures, of flexible connector 20 are contemplated that attain the desired flexibility. For example, flexible connector 20 can comprise a wire, a strip, and other shapes. The wire can be in the form of a solid straight wire (e.g., no braiding, twisting, or weaving, or the sort), braided solid wires (see FIG. 3B), twisted strands (e.g., rope), and links (e.g., comprising hinges), see FIG. 3C), as well as combinations comprising at least one of the foregoing that are arranged so as to form a strip.

For example, the connector 20 can comprises strip(s), e.g., greater than or equal to 2, specifically, greater than or equal to 3, and more specifically, greater than or equal to 4 strips (e.g., thin foils and/or braided metal strips) that are connected together at their ends by the securing mechanism 58. (See FIG. 3) The strips have a size dependent upon the amount of heat to be removed from the light source and the thermal conductivity of the strips. For example, the strips can have a width of 5 mm to 25 mm, specifically, 10 mm to 20 mm; an overall thickness of 0.1 mm to 1 mm, specifically, 0.3 mm to 0.8 mm, and more specifically, 0.3 mm to 0.6 mm; and a length of greater than or equal to 10 mm, specifically 10 mm to 150 mm, and more specifically, 10 mm to 100 mm. The strips can be formed by flat, smooth sheets, braided strands, woven strands, twisted strands (e.g., ropes), and so forth, as well as combinations comprising at least one of the foregoing. The braided metal strips and/or twisted strands can be formed from wire having gauges of 0.1 mm to 0.5 mm. The thin foils can have a thickness of greater than or equal to 0.01 mm, specifically, greater than or equal to 0.05 mm, and more specifically, 0.05 mm to 0.5 mm, yet more specifically, 0.05 mm to 0.15 mm. The specific length of the connector is partially dependent upon having a sufficient length to enable the desired flexibility (e.g., enable movement of the light source). For example, for braided, woven, or twisted strands, the length of the connector can be greater than or equal to 20 millimeters (mm), while if the connector comprises hinges (e.g., links), the length can be greater than or equal to 10 mm.

It has been determined that the use of flexible connector 20 can effectively reduce the temperature of the LED 36 and the LED chip 44 by conducting heat away from the LED chip 44 and PCB area (e.g., substrate 38).

Figure 7:
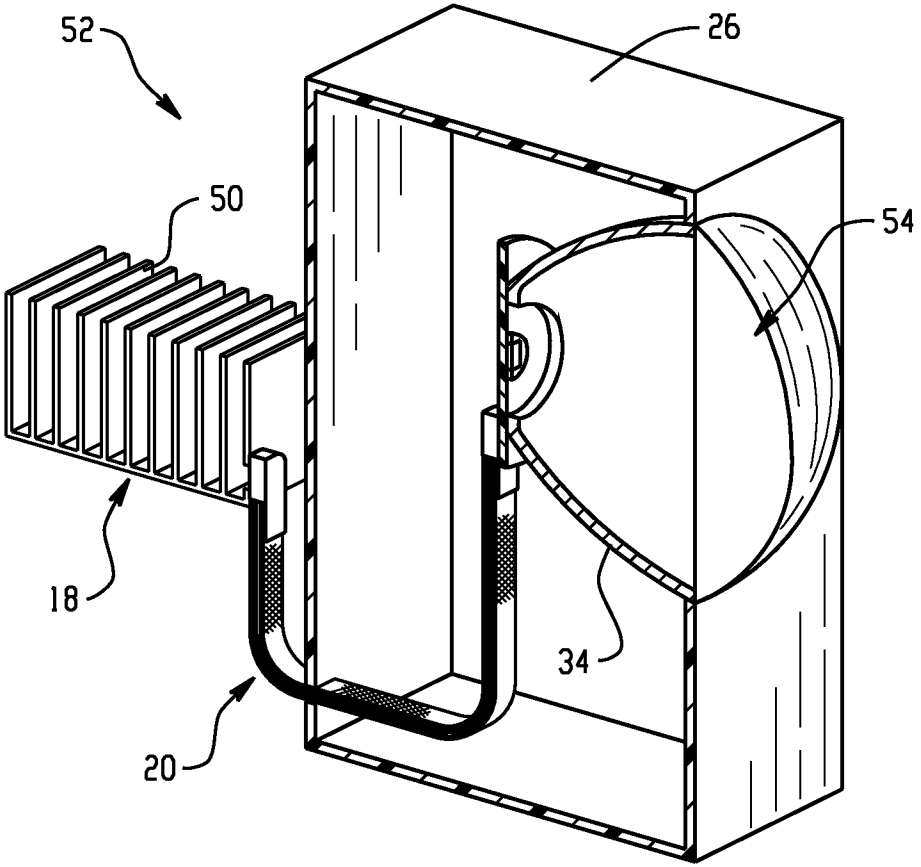
FIG. 7 is a perspective view of simplified architecture of a LED headlamp assembly comprising a braided copper wire as a heat dissipation mechanism.
Figure 6:
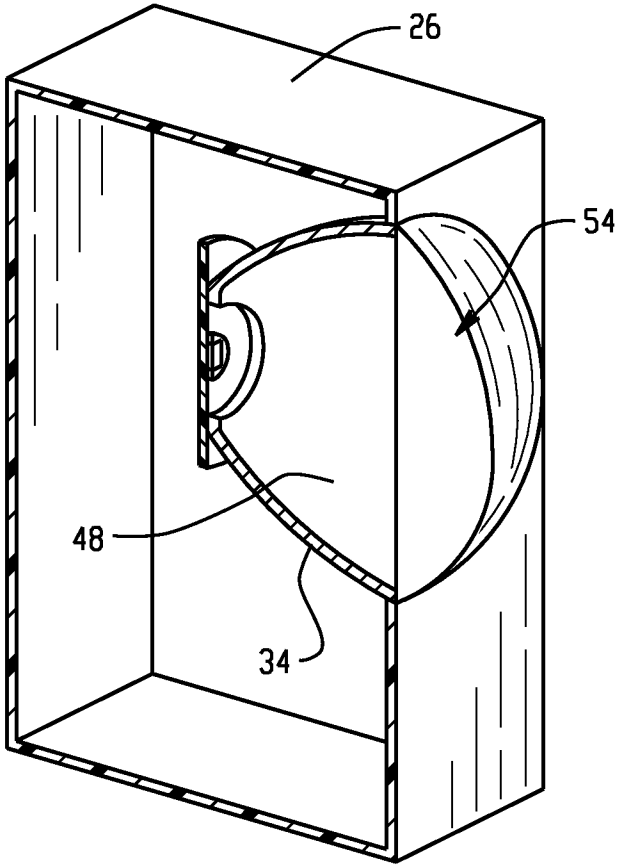
FIG. 6 is a perspective view of a comparative LED headlamp assembly without a heat dissipation mechanism.
Figure 9:
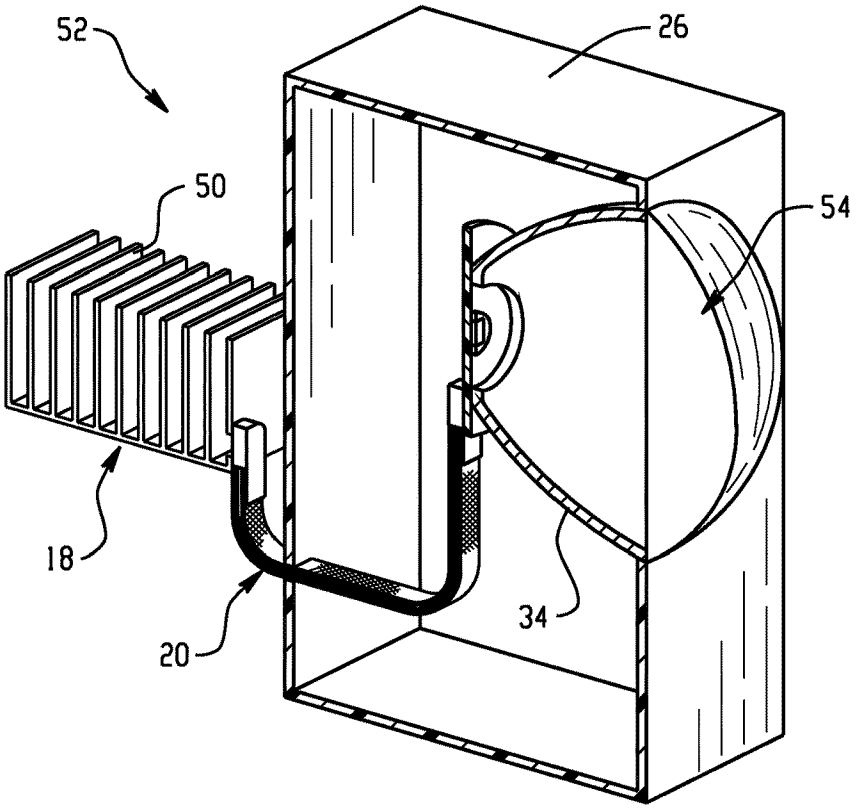
FIG. 9 is a perspective view of simplified architecture of a LED headlamp assembly comprising a braided copper wire as a heat dissipation mechanism as in FIG. 7, but having a shorter length.
Figure 8:
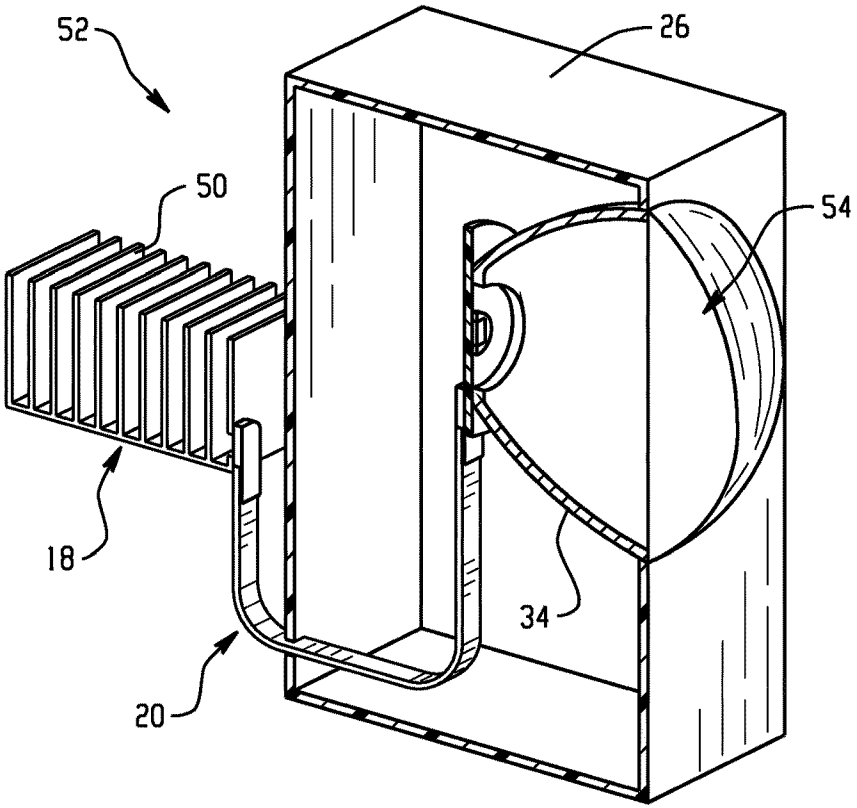
FIG. 8 is a perspective view of simplified architecture of a LED headlamp assembly comprising a copper bus bar.

FIGS. 7-9 illustrate simplified architecture regarding embodiments of the headlamp assemblies described herein using various heat dissipating mechanisms (e.g., various connectors 20). For example, FIG. 7 depicts connector 20 comprising a braided copper wire, as also described above. FIG. 8 depicts flexible connector 20 comprising a copper strip. FIG. 9 illustrates connector 20 as comprising a braided metal (e.g., copper) wire, having a length shorter than the length of both the braided copper wire of FIG. 7 and the copper strip of FIG. 8. Although copper is described as the material for connector 20 in FIGS. 7-9, it will be appreciated that metals other than copper also could be employed. FIG. 6 illustrates a simplified architecture regarding a comparative design without the heat dissipating mechanism (without connector 20) and which is referred to in the Example below.

Thermal analysis was conducted regarding the designs of FIGS. 6-9 to demonstrate the effectiveness of connectors 20 in dissipating heat away from the LED area of a LED headlamp assembly, the details of which are described in the EXAMPLE below and the results are set forth in Table 1.

EXAMPLE

In this simulated Example, thermal analysis was conducted on each of the designs shown in FIGS. 6-9 (Examples 1-4, respectively) by, in a room temperature (23° C.) environment, applying heat at the LED simulated location (e.g., 36 in FIG. 5). For Examples 2-4, the connector had a width of 10 mm and an overall thickness of 2 mm. Example 2 (illustrated in FIG. 7) comprised four strips of 0.5 mm gauge braided copper wire having a length of 122.5 mm. Example 3 (illustrated in FIG. 8) comprised a single strip of copper foil having a length of 122.5 mm. Example 4 (illustrated in FIG. 9) comprised four strips of 0.5 mm gauge braided copper wire having a length of 86 mm. Two cases are considered, one with an air flow of 16.66 meters per second (m/s) (60 kilometers per hour (km/hr)) over heat sink (forced convection) and other with no air flow (stagnant air) other than this all other conditions are same, only the connector geometry is modified).

TABLE 1

| Example | 1 | 2 | | | 3 | 4 | |
|---|---|---|---|---|---|---|---|
| Design | FIG. 6 Baseline | FIG. 7 no air flow | FIG. 7 with air flow | No air flow | FIG. 8 with air flow | FIG. 9 no air flow | FIG. 9 with air flow |
| Maximum LED Chip Temperature (° C.) | 137.2 | 98.6 | 95.7 | 105.4 | 104.1 | 88.2 | 85 |

From Table 1, it can be observed that an effective reduction in chip temperature was achieved with the design of FIGS. 7 and 8. Specifically, the comparative design of FIG. 6 (baseline design) without any heat dissipation mechanism (i.e., no connector 20, had a maximum LED chip temperature of 137.2° C. In contrast, use of braided copper wire as connector 20 in the design of FIG. 7 resulted in greater than or equal to a 28 percent (%) reduction in chip temperature, and the single strip of copper foil connector 20 of FIG. 8 resulted in greater than or equal to a 23.2% reduction in chip temperature. Use of the shorter braided copper strip connector 20 of FIG. 9 resulted in an even greater reduction in chip temperature, i.e., greater than or equal to a 35.7% reduction.

Regarding the afore-described testing with the added inclusion of air flow, as shown in Table 1, the airflow in combination with connector 20 resulted in even further reduction of chip temperature in the embodiments tested. Specifically, the following reduction in chip temperature in comparison to the baseline was achieved, respectively, for FIGS. 7, 8, and 9 with the added use of airflow: greater than or equal to 30.3%, 24.1%, and 38.1%.

Thus, the foregoing results demonstrate that the use of connector 20 can effectively dissipate heat away from the LED module 12 thereby reducing the temperature thereof. Connector designs having a reduced length, e.g., that extended directly from the LED module 12 to the heat sink 18 were particularly effective.

The heat dissipating systems have been described herein with respect to vehicles. However, use of the disclosed systems in other lighting applications are clearly contemplated.

In an embodiment, a heat dissipating system for a light can comprise: a light source comprising an LED; a reflector adjacent the LED; a housing around the LED module; and a flexible conductive connector attached at one end to a heat sink and at another end to the light source. The connector is configured to conduct heat away from the light source and to the heat sink. The heat sink is located remote from the light source.

In another embodiment, a heat dissipating system for a light can comprise: a light source comprising an LED; a reflector adjacent the LED; a housing around the LED module; and a thermally conductive connector attached at one end to a heat sink and at another end to the light source. The thermally conductive connector is configured to conduct heat away from the light source and to the heat sink, and enables beam pattern adjustment without movement of the heat sink. The heat sink is located remote from the light source.

In another embodiment, a vehicle headlamp heat dissipating system can comprise: a vehicle headlamp comprising a LED module and a reflector in a housing; a heat sink located in the vehicle external to the housing; and a flexible conductive connector connected at one end to the heat sink and at another end to the LED module, and configured to conduct heat away from the LED module and to the heat sink.

In an embodiment, a method of dissipating heat away from a LED module can comprise: conducting heat from the LED module through a flexible conductive connector to a heat sink, wherein a lamp (e.g., a headlamp) comprises the LED module, a housing, and a reflector, and wherein the heat sink is located external to the LED housing.

In the various embodiments: (i) the heat sink is spaced from the LED by greater than or equal to 10 mm and/or (ii) the flexible conductive connector comprises at least one of a wire, a bus bar, a laminate, and a foil; and/or (iii) the connector is in the form of a strip and comprises at least one of braided metal wire, twisted metal wire, and woven metal wire; and/or (iv) the connector comprises greater than or equal to two strips with securing mechanisms on the ends of flexible conductive connector, binding the strips together; and/or the flexible conductive connector is a foil; and/or (v) the flexible conductive connector comprises greater than or equal to 3 of the strips of the braided metal wires; and/or (vi) the light comprises a motor configured to move the LED while not moving the heat sink; and/or (vii) the heat sink is a structural body forming a vehicle; and/or (viii) the heat sink is located remote from the housing; and/or (ix) the heat sink is located remote from the light; and/or (x) the heat sink is located greater than or equal to 50 mm from the LED; and/or (xi) the heat sink is located outside the housing; and/or (xii) the heat sink is located greater than or equal to 10 mm from the housing; and/or (xiii) further comprising a motor configured to move the LED while not moving the heat sink; and/or (xiv) further comprising a sheath around the connector; and/or (xv) the light source has a wattage of greater than or equal to 20 W and wherein the connector has a thermal conductivity of greater than or equal to 100 W/m·K; and/or (xvi) the connector comprises at least one of aluminum, copper, silver, and magnesium; and/or (xvii) the light source has a wattage of less than 20 W and wherein the connector has a thermal conductivity of greater than or equal to 4 W/m·K; and/or (xviii) the light source has a wattage of 5 W to 10 W; and/or the connector comprises thermally conductive plastic; and/or (xix) the light source has a wattage of greater than or equal to 25 W; and/or (xx) the light source has a wattage of greater than or equal to 30 W; and/or (xxi) the light source has a wattage of greater than or equal to 40 W; and/or (xxii) a beam pattern of the light source can be adjusted without moving the heat sink; and/or (xxiii) the connector is configured to enable the light source to move (e.g., enable beam pattern adjustment) while not moving the heat sink.

In general, the architecture and process may alternately comprise, consist of, or consist essentially of, any appropriate components herein disclosed. The invention may additionally, or alternatively, be formulated so as to be devoid, or substantially free, of any components, materials, ingredients, adjuvants or species used in the prior art compositions or that are otherwise not necessary to the achievement of the function and/or objectives of the present invention.

All ranges disclosed herein are inclusive of the endpoints, and the endpoints are independently combinable with each other (e.g., ranges of "up to 25 wt. %, or, more specifically, 5 wt. % to 20 wt. %", is inclusive of the endpoints and all intermediate values of the ranges of "5 wt. % to 25 wt. %," etc.). "Combination" is inclusive of blends, mixtures, alloys, reaction products, and the like. Furthermore, the terms "first," "second," and the like, herein do not denote any order, quantity, or importance, but rather are used to differentiate one element from another. The terms "a" and "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the film(s) includes one or more films). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

Any and all cited patents, patent applications, and other references are incorporated herein by reference in their entirety. However, if a term in the present application contradicts or conflicts with a term in the incorporated reference, the term from the present application takes precedence over the conflicting term from the incorporated reference.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

We claim:

1. A heat dissipating system for a light mechanism, comprising:

a flexible thermally conductive connector attached at one end to a heat sink and at another end to an LED module, wherein the light mechanism comprises a light source comprising an LED;

a reflector adjacent the LED; and a housing around the light source;

wherein the connector is configured to conduct heat away from the light source and to the heat sink, wherein the connector comprises at least one of a wire, a bus bar, a laminate, and a foil;

wherein the heat sink is located remote from the light mechanism, with the connector thermally connecting the heat sink to the light source;

wherein the light source has a wattage of greater than or equal to 20 W and wherein the connector has a thermal conductivity of greater than or equal to 100 W/m·K;

wherein the heat sink is located external to, and distanced away from, the housing; and wherein the connector is not rigid enough to support a weight of the housing.

2. The heat dissipating system of claim 1, wherein the heat sink is spaced from the LED module by greater than or equal to 10 mm.

3. The heat dissipating system of claim 1, wherein the heat sink is located outside the housing.

4. The heat dissipating system of claim 3, wherein the heat sink is spaced from the housing by greater than or equal to 10 mm.

5. The heat dissipating system of claim 1, wherein the connector is in the form of a strip and comprises at least one of braided metal wire, twisted metal wire, and woven metal wire.

6. The heat dissipating system of claim 5, wherein the connector comprises greater than or equal to two strips with securing mechanisms on the ends of flexible conductive connector, binding the strips together.

7. The heat dissipating system of claim 1, further comprising a motor configured to move the LED while not moving the heat sink.

8. The heat dissipating system of claim 7, wherein the heat dissipating system is for a vehicle LED headlamp and wherein the heat sink is a vehicle structural body.

9. The heat dissipating system of claim 1, further comprising a sheath around the connector.

10. The heat dissipating system of claim 1, wherein the light source has a wattage of greater than or equal to 30 W.

11. The heat dissipating system of claim 10, wherein the connector comprises at least one of aluminum, copper, silver, and magnesium.

12. The heat dissipating system of claim 1, wherein the light source has a wattage of greater than or equal to 40 W.

13. The heat dissipating system of claim 1, wherein the connector comprises thermally conductive plastic.

14. A method of dissipating heat away from a light emitting diode mounted in a headlamp of a vehicle using the heat dissipation system of claim 1, comprising:

connecting one end of the flexible conductive connector to the LED module comprising the LED; and connecting another end of the flexible conductive connector to the heat sink which is located in the vehicle external to the headlamp and at a distance from the LED module, wherein the flexible conductive connector conducts heat away from the LED module to the heat sink thereby reducing temperature of the LED module.

15. The heat dissipating system of claim 1, wherein the connector comprises at least one of braided metal wire and woven metal wire.

16. The heat dissipating system of claim 1, wherein the connector is directly attached to the heat sink and to the LED module.

17. A vehicle headlamp heat dissipating system, comprising:

a vehicle headlamp comprising an LED module and a reflector in a housing, wherein the LED module comprises a light source having a wattage of greater than or equal to 20 W;

a heat sink located in the vehicle external to the housing; and a flexible conductive connector connected at one end to the heat sink and at another end to the LED module, and configured to conduct heat away from the LED module and to the heat sink;

wherein the heat sink is located external to, and distanced away from, the housing; and wherein the connector is not rigid enough to support a weight of the housing.

18. A heat dissipating system for a light mechanism, comprising:

a thermally conductive connector attached at one end to a heat sink and at another end to an LED module, wherein the light mechanism comprises:

a light source comprising an LED and having a wattage of greater than or equal to 20 W;

a reflector adjacent the LED; and a housing around the LED module;

wherein the thermally conductive connector is configured to conduct heat away from the light source and to the heat sink, and enables beam pattern adjustment without movement of the heat sink;

wherein the heat sink is located remote from the light mechanism and has a thermal conductivity of greater than or equal to 50 W/m·K;

wherein the heat sink is located external to, and distanced away from, the housing; and wherein the connector is not rigid enough to support a weight of the housing.

19. The heat dissipating system of claim 18, wherein the connector comprises at least one of braided metal wire and woven metal wire.

20. The heat dissipating system of claim 18, wherein the light source has a wattage of greater than or equal to 30 W.

* * * * *